US010961693B2

(12) United States Patent
Lazar

(10) Patent No.: US 10,961,693 B2
(45) Date of Patent: Mar. 30, 2021

(54) DUAL FLUSH FLAPPER VALVE APPARATUS

(71) Applicant: Steven Lazar, Henderson, NV (US)

(72) Inventor: Steven Lazar, Henderson, NV (US)

( * ) Notice: Subject to any disclaimer, the term of this patent is extended or adjusted under 35 U.S.C. 154(b) by 29 days.

(21) Appl. No.: 16/451,160

(22) Filed: Jun. 25, 2019

(65) Prior Publication Data

US 2020/0407959 A1 Dec. 31, 2020

(51) Int. Cl.
*E03D 1/14* (2006.01)
*E03D 5/094* (2006.01)
*E03D 1/34* (2006.01)

(52) U.S. Cl.
CPC ..... *E03D 1/142* (2013.01); *E03D 1/34* (2013.01); *E03D 5/094* (2013.01)

(58) Field of Classification Search
CPC ..... E03D 1/14–145; E03D 1/34–36; E03D 1/306; E03D 1/025; E03D 1/22
See application file for complete search history.

(56) References Cited

U.S. PATENT DOCUMENTS 2,774,972 A * 12/1956 Nelson ..... F16K 1/2028 4/392
3,156,930 A * 11/1964 Moulton ..... E03D 1/144 4/325
3,758,893 A * 9/1973 Smolinski ..... E03D 1/145 4/327
4,499,616 A * 2/1985 Johnson ..... E03D 1/34 4/393
5,261,129 A 11/1993 Roy
5,754,986 A * 5/1998 Chien ..... E03D 1/145 4/327
5,855,025 A * 1/1999 Williams ..... E03D 1/306 4/353
6,742,194 B2 6/2004 Shim
6,829,787 B1 * 12/2004 Pipenburg ..... E03D 1/306 4/393
7,200,877 B2 4/2007 Peng
7,591,027 B2 * 9/2009 Scruggs ..... E03D 1/145 4/327
7,827,627 B2 11/2010 Dayton
8,584,268 B2 11/2013 Han
8,943,620 B2 2/2015 Schuster
9,689,154 B2 * 6/2017 Lopez Aguero ..... E03D 1/142

* cited by examiner

*Primary Examiner* — David P Angwin
*Assistant Examiner* — Nicholas A Ros

(57) ABSTRACT

A dual flush flapper valve apparatus for converting a standard toilet to a dual flush system includes a valve body having a lower rim and an upper rim. The lower rim is configured to selectively engage a tank valve of a toilet. A valve top is coupled to the valve body and is selectively engageable with the upper rim to seal and alternatively unseal a top aperture. A first chain and a second chain are configured to attach to a trip lever of the toilet to move the valve top between a closed position. The first chain and the second chain are arranged such that a partial depression of a handle of the toilet lifts the trip lever to move the valve top to the open position and a full depression of the handle lifts the trip lever further to move the valve body to the lifted position.

6 Claims, 7 Drawing Sheets

DUAL FLUSH FLAPPER VALVE APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to toilet flush valves and more particularly pertains to a new toilet flush valve for converting a standard toilet to a dual flush system.

BRIEF SUMMARY OF THE INVENTION

An embodiment of the disclosure meets the needs presented above by generally comprising a valve body having a lower rim defining a bottom aperture, an upper rim defining a top aperture, and a sidewall extending from the lower rim to the upper rim. The lower rim is configured to selectively engage a tank valve seat of a toilet to seal and alternatively unseal the tank valve seat. The valve body has a body chain attachment coupled to the sidewall proximal the upper rim. A valve top is coupled to the valve body and is selectively engageable with the upper rim to seal and alternatively unseal the top aperture. The valve top has a valve chain attachment. A top collar is coupled to the top hinge and is configured to be coupled to an overflow tube of the toilet. A top hinge is pivotably coupled to the top collar. A first chain is coupled to the valve chain attachment and is configured to attach to a trip lever of the toilet to move the valve top between a closed position sealing the top aperture and an alternate open position unsealing the top aperture. A bottom hinge is coupled to the sidewall adjacent the lower rim. The bottom hinge is pivotably coupled to the bottom collar. A second chain is coupled to the body chain attachment and is configured to attach to the trip lever to move the valve body from a lowered position selectively engaging the tank valve seat to an alternate lifted position exposing the tank valve seat. The first chain and the second chain are arranged such that a partial depression of a handle of the toilet lifts the trip lever to move the valve top to the open position and a full depression of the handle lifts the trip lever further to move the valve body to the lifted position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
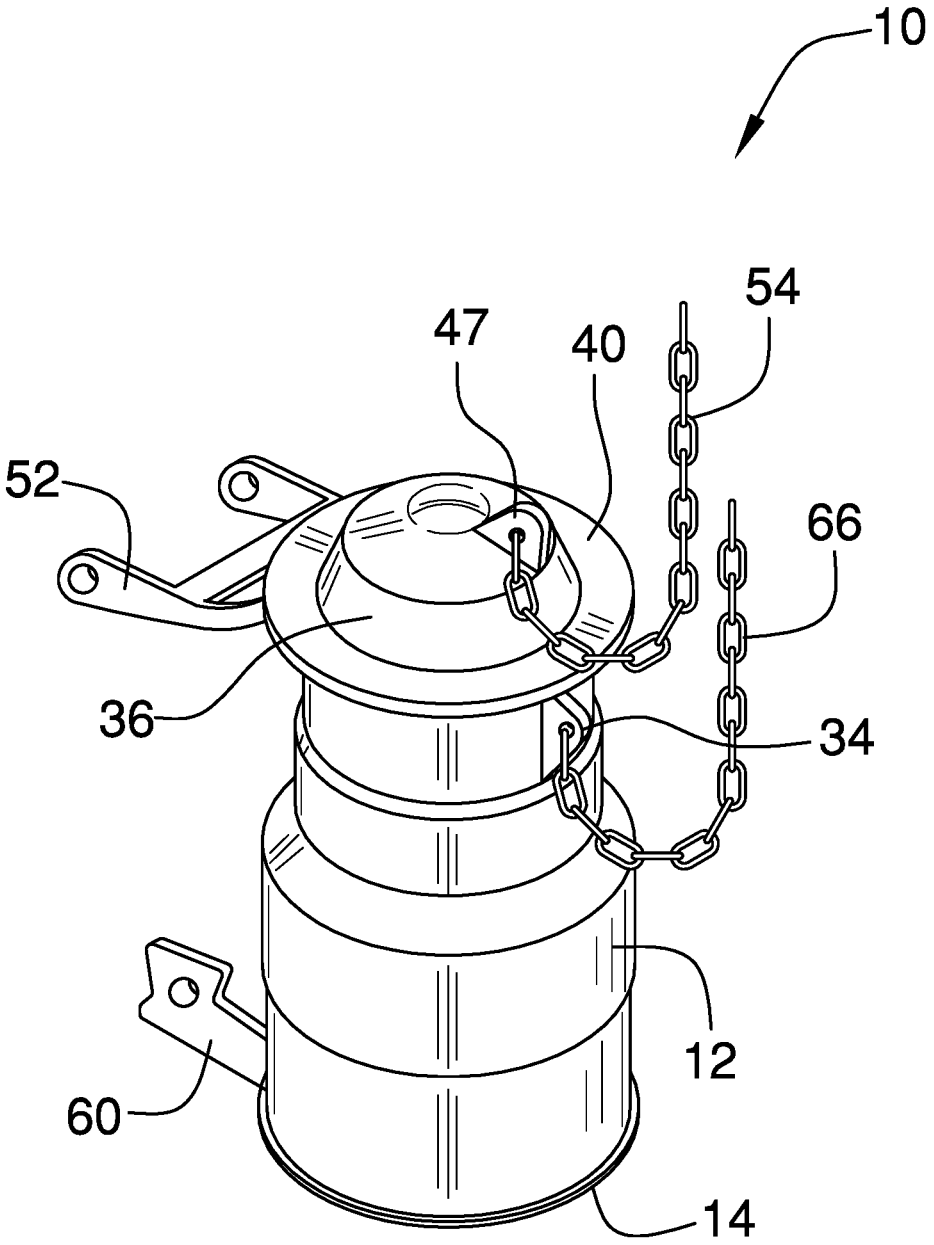
FIG. 1 is an isometric view of a dual flush flapper valve apparatus according to an embodiment of the disclosure.
Figure 2:
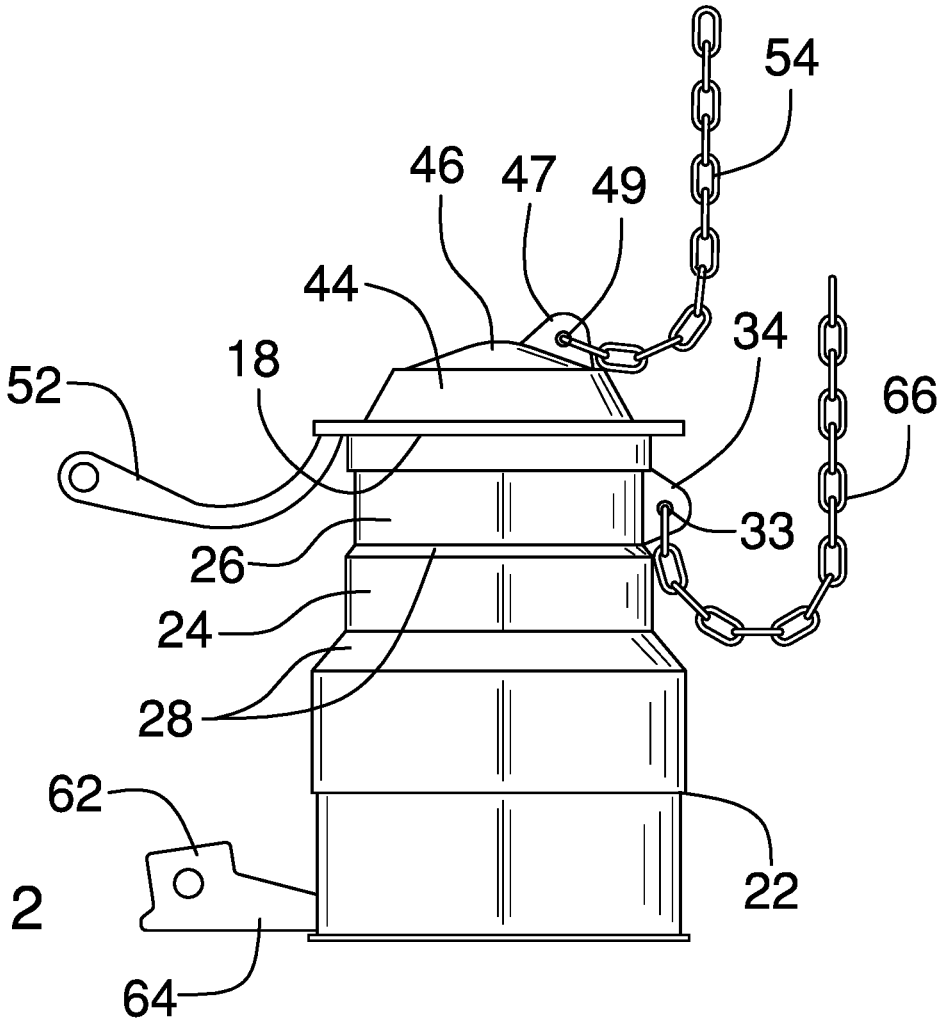
FIG. 2 is a side elevation view of an embodiment of the disclosure.
Figure 3:
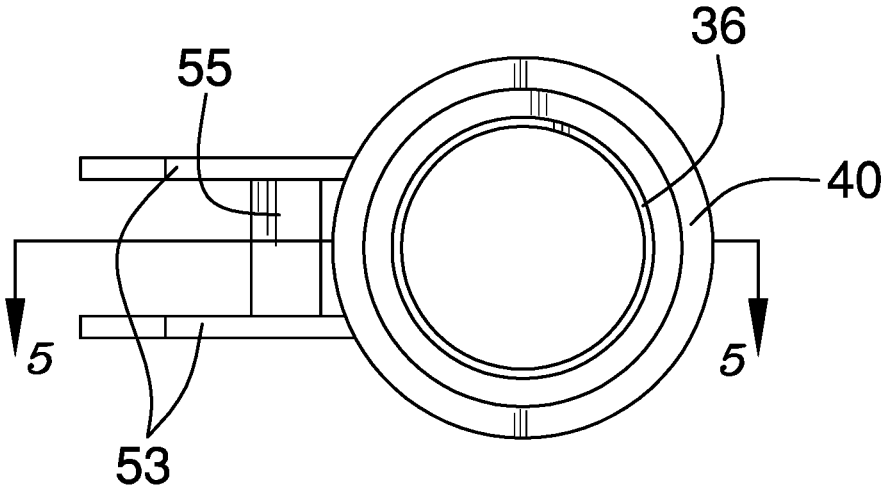
FIG. 3 is a bottom plan view of an embodiment of the disclosure.
Figure 4:
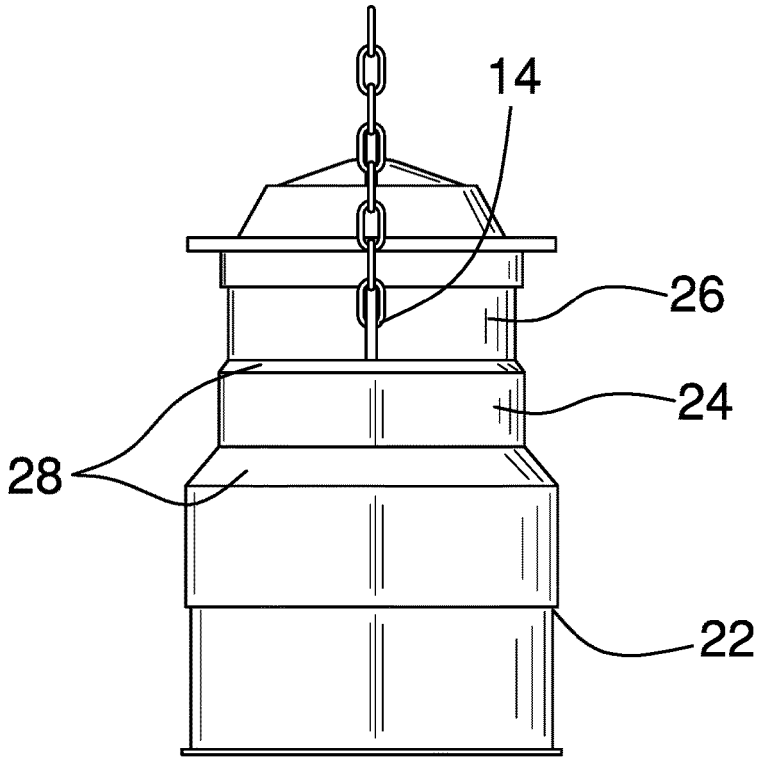
FIG. 4 is a front elevation view of an embodiment of the disclosure.
Figure 5:
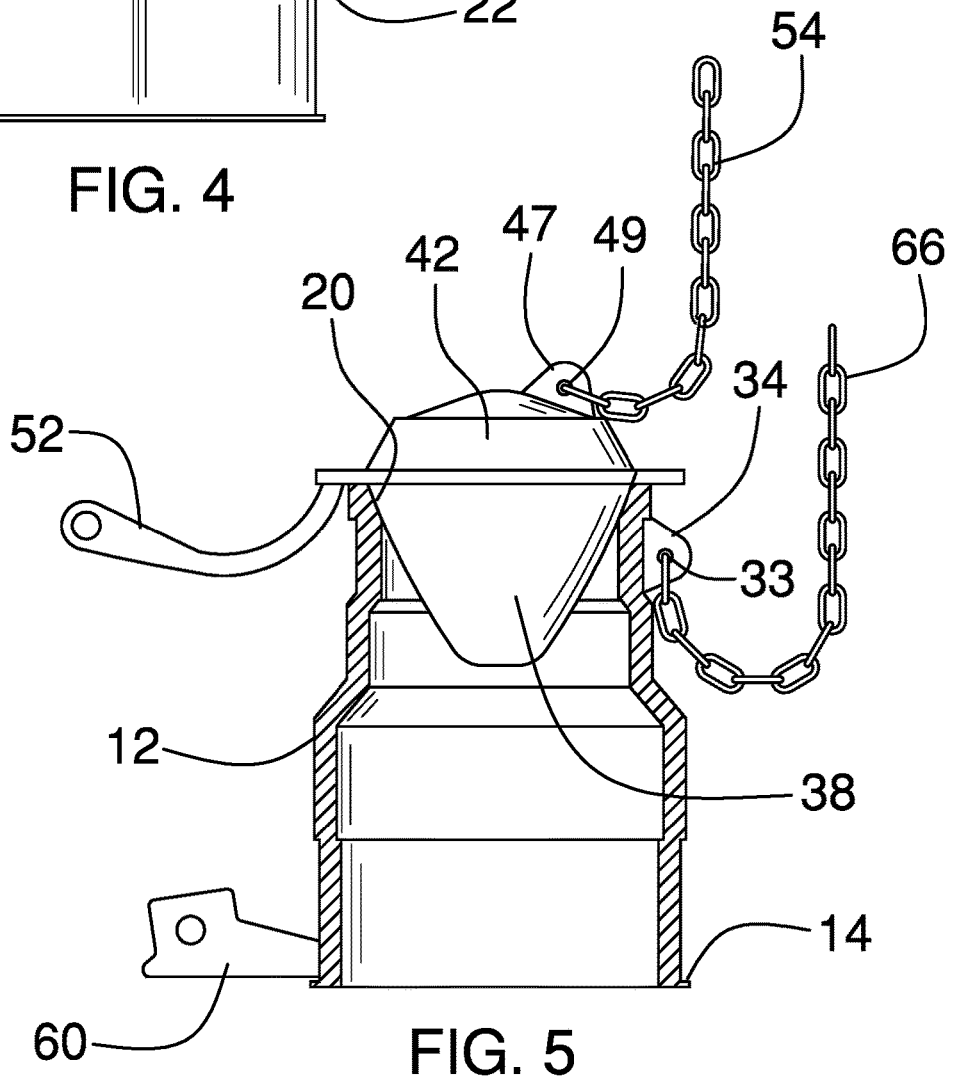
FIG. 5 is a cross section view along the line 5-5 of an embodiment of the disclosure.
Figure 6:
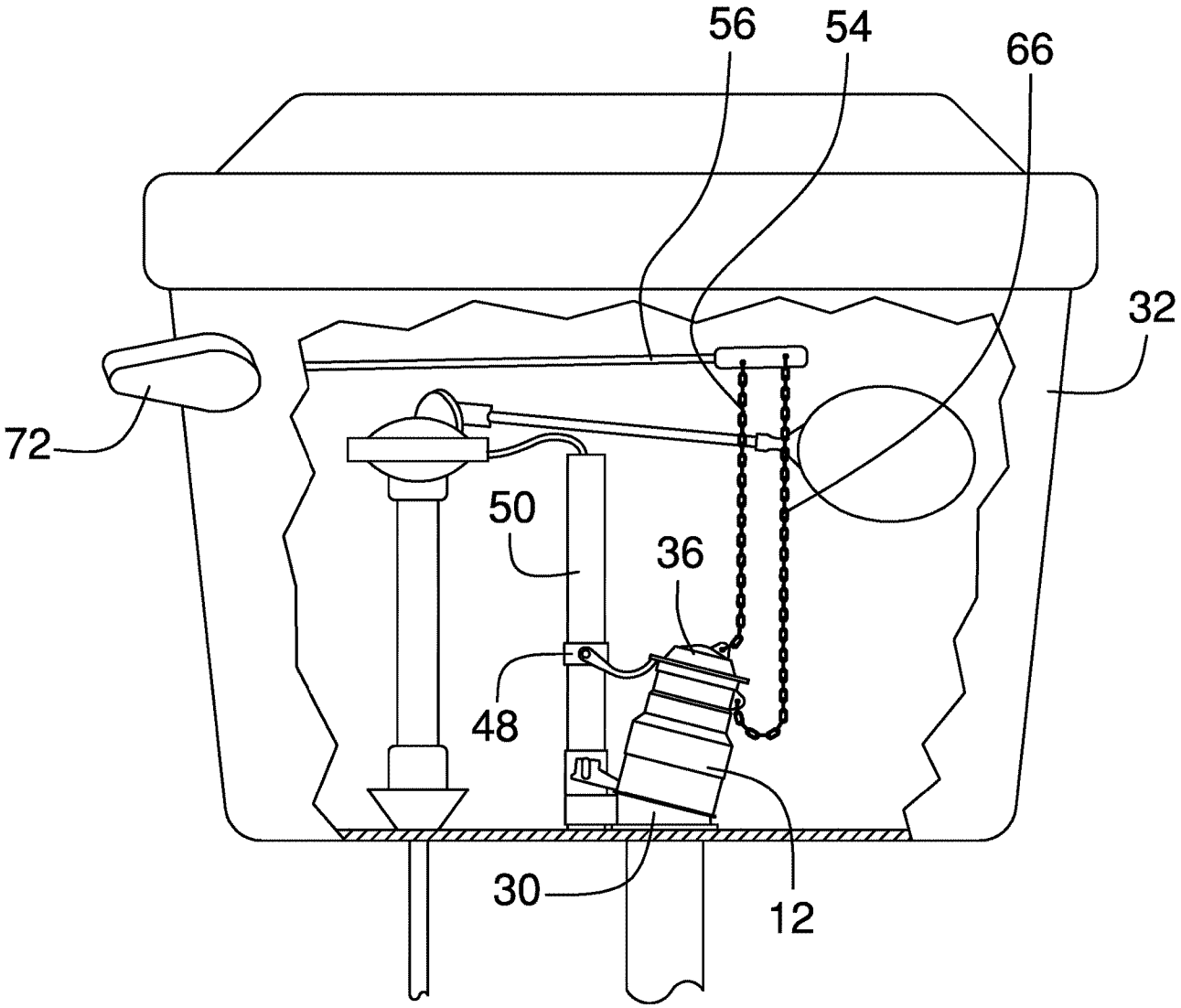
FIG. 6 is an in-use view of an embodiment of the disclosure.
Figure 7:
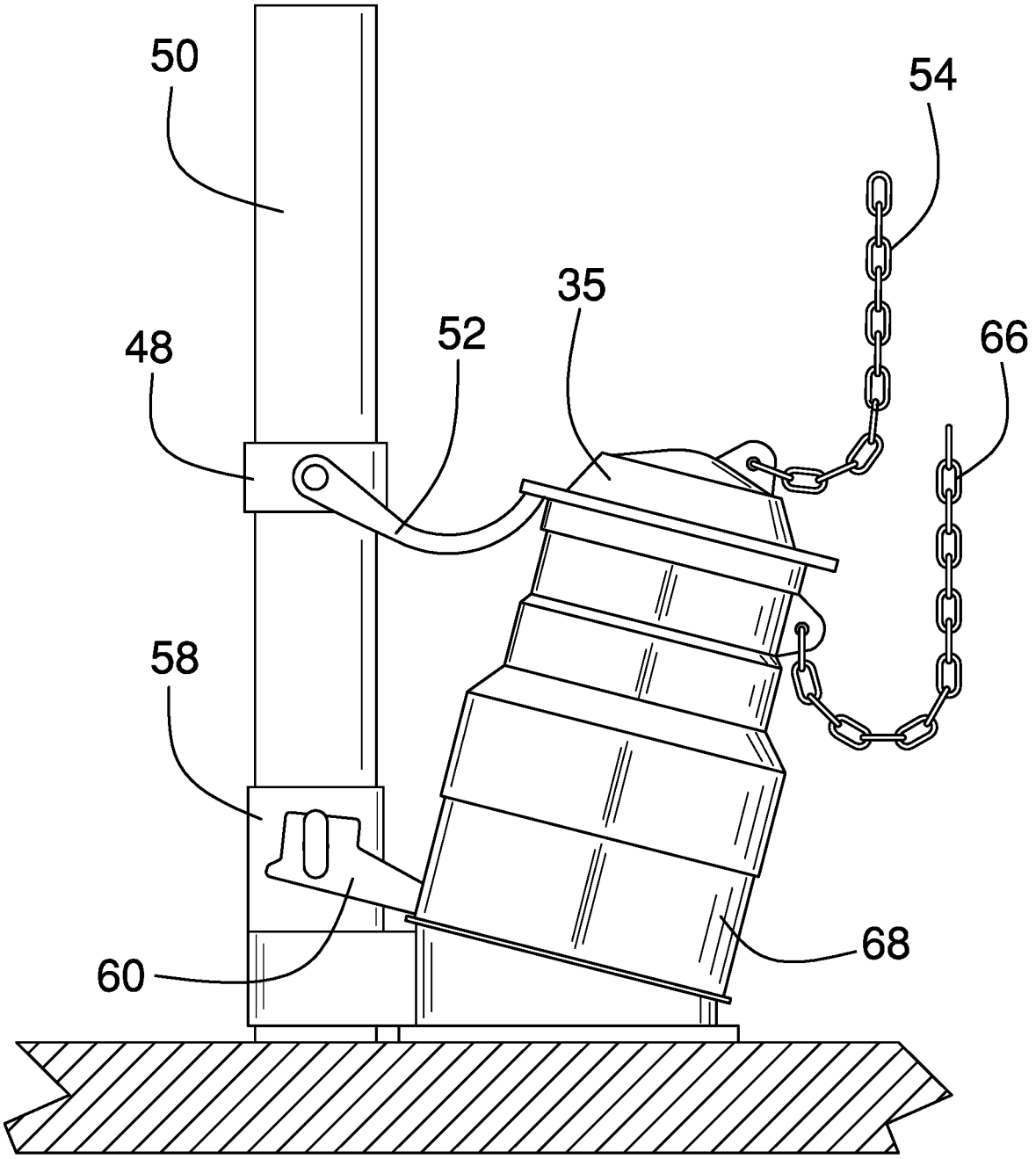
FIG. 7 is an in-use view of an embodiment of the disclosure.
Figure 8:
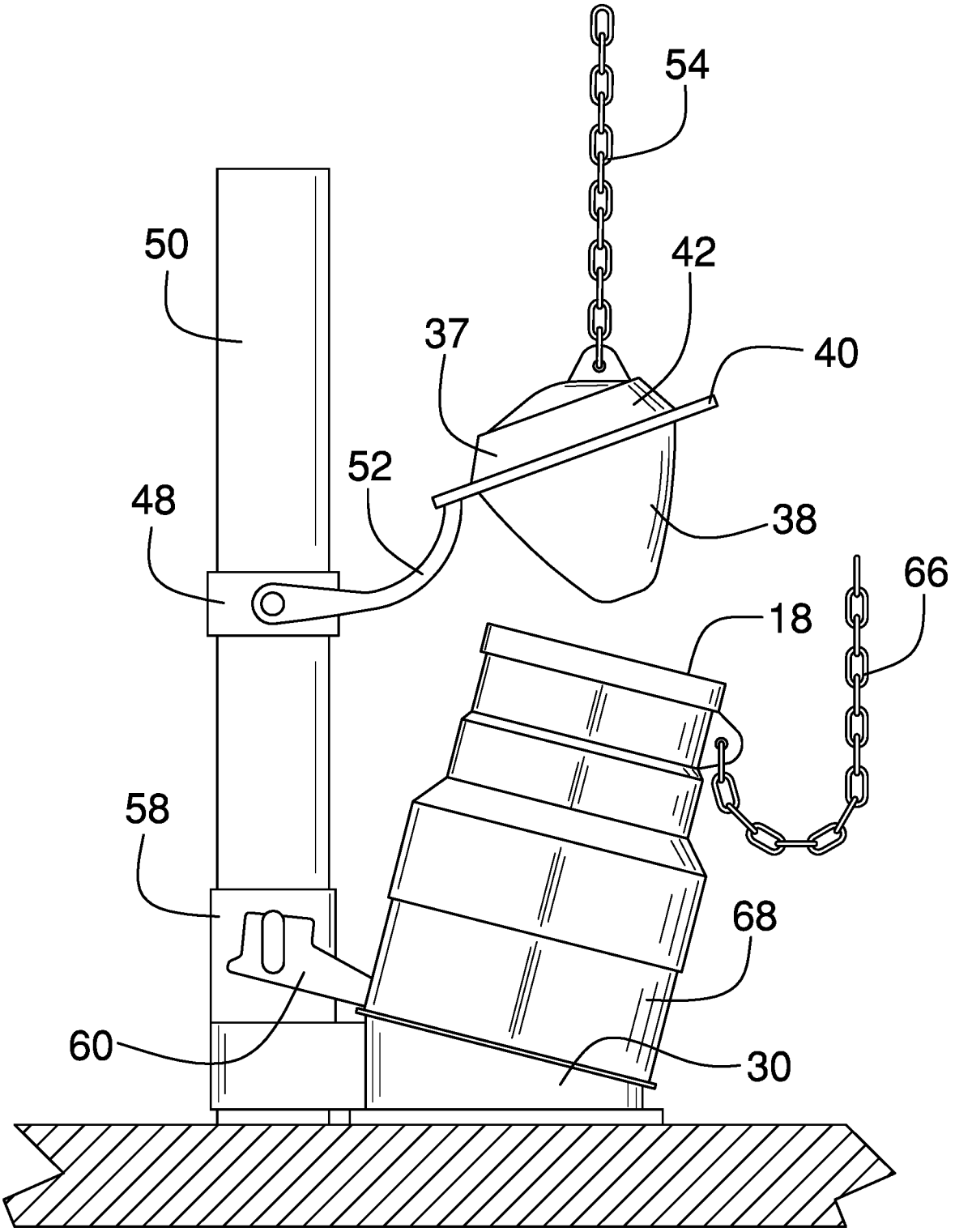
FIG. 8 is an in-use view of an embodiment of the disclosure.
Figure 9:
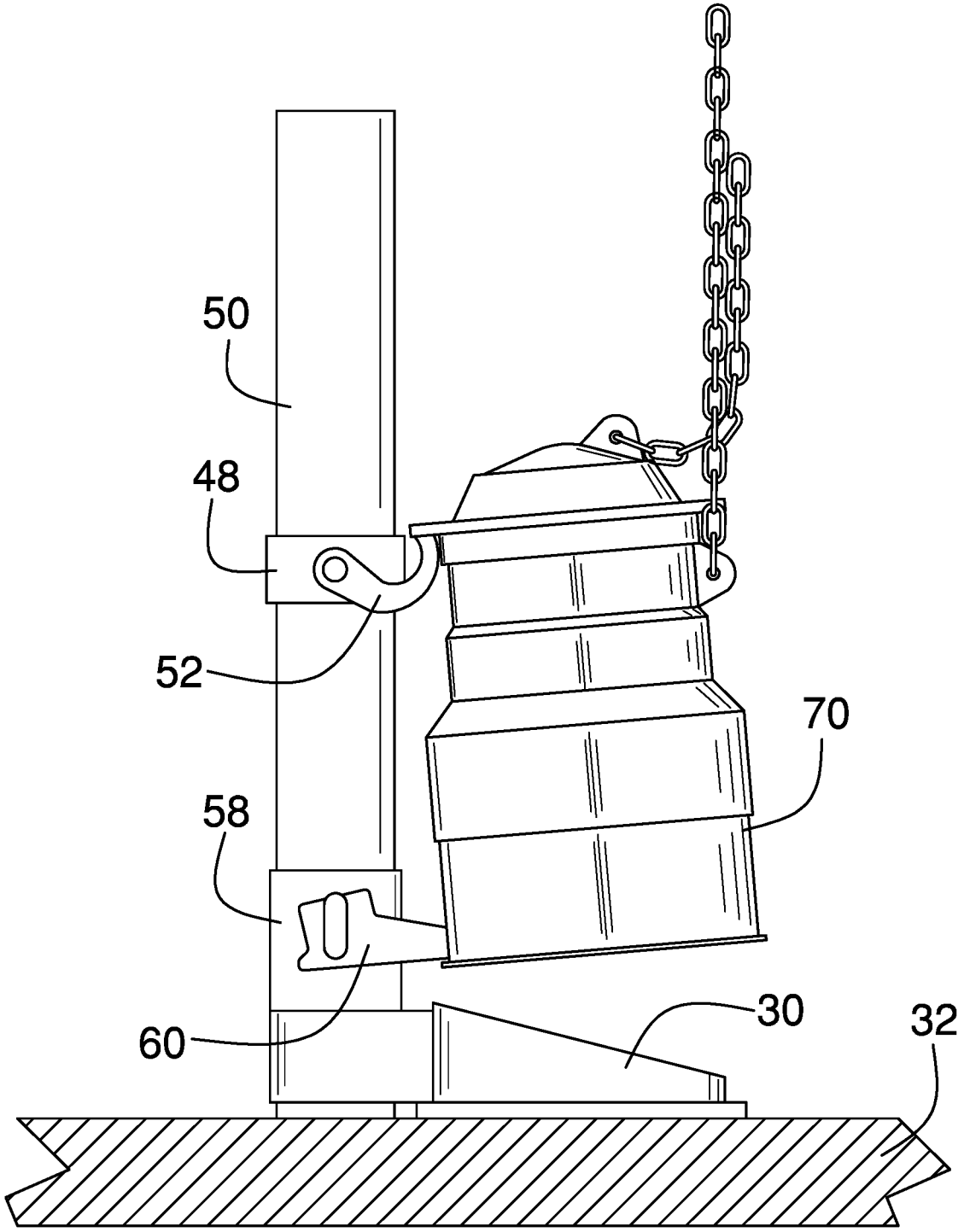
FIG. 9 is an in-use view of an embodiment of the disclosure.

With reference now to the drawings, and in particular to FIGS. 1 through 9 thereof, a new toilet flush valve embodying the principles and concepts of an embodiment of the disclosure and generally designated by the reference numeral 10 will be described.

As best illustrated in FIGS. 1 through 9, the dual flush flapper valve apparatus 10 generally comprises a valve body 12 having a lower rim 14 defining a bottom aperture 16, an upper rim 18 defining a top aperture 20, and a sidewall 22 extending from the lower rim 14 to the upper rim 18. The valve body 12 is stepped with a diameter of the bottom aperture 16 being greater than a diameter of the top aperture 20. The valve body 12 comprises a lower step 22, a medial step 24, and an upper step 26. The medial step 24 has a pair of angled transitions 28 between each of the lower step 22 and the upper step 26. The lower rim 14 is configured to selectively engage a tank valve seat 30 of a toilet 32 to seal and alternatively unseal the tank valve seat 30. The valve body 12 has a body chain attachment 34 coupled to the sidewall 22 proximal the upper rim 18. The body chain attachment 34 may be a rounded triangular shape with a first central aperture 33 extending therethrough. A valve top 36 is coupled to the valve body 12. The valve top 36 has a cone portion 38, a disk portion 40 coupled to the cone portion 38, and a hat portion 42 coupled to the disk portion 40. The cone portion 38 is selectively engageable within the top aperture 20 and an underside of the disk portion is selectively engageable with the upper rim 18 to seal and alternatively unseal the top aperture 20. The hat portion 42 has an angled section 44 and a rounded top section 46. The disk portion 40 has a diameter greater than a diameter of each of the cone portion 38 and the hat portion 42 to create a strong seal on the upper rim 18. The valve top 36 has a valve chain attachment 47 coupled to the rounded top section 46 of the hat portion 42. The valve chain attachment 47 may be a rounded triangular shape with a second central aperture 49 extending therethrough.

A top collar 48 is configured to be coupled to an overflow tube 50 of the toilet 32. A top hinge 52 is coupled to the underside of the disk portion 40 and pivotably coupled to the top collar 48. The top hinge 52 is curved and flexible and may comprise a pair of outer arms 53 and a bridge 55 extending therebetween. A first chain 54 is coupled to the valve chain attachment 47 and configured to attach to a trip lever 56 of the toilet 32 to move the valve top 36 between a closed position 35 sealing the top aperture 20 and an alternate open position 37 unsealing the top aperture 20. A bottom collar 58 is configured to be coupled to the overflow tube 50 of the toilet 32 beneath the top collar 48. A bottom hinge 60 is coupled to the valve body 12. The bottom hinge 60 has a squared shoulder portion 62 pivotably coupled to the bottom collar 58 and a tapered arm portion 64 extending from the shoulder portion 62 to the sidewall 22 of the valve body 12 adjacent the lower rim 14. A second chain 66 is coupled to the body chain attachment 34 and configured to attach to the trip lever 56 to move the valve body 12 from a lowered position 68 selectively engaging the tank valve seat 30 to an alternate lifted position 70 exposing the tank valve seat 30. The top hinge 52 is arranged to pivot on the top collar 48 when the first chain 54 lifts the valve top 36 to the open position 37 and alternatively to flex and maintain the valve top 36 in the closed position 35 when the second chain 66 lifts the valve body 12 to the lifted position 70. The first chain 54 and the second chain 66 are arranged such that a partial depression of a handle 72 of the toilet 32 lifts the trip lever 56 to move the valve top 36 to the open position 37 and a full depression of the handle 72 lifts the trip lever 56 further to move the valve body 12 to the lifted position 70.

In use, the user engages the handle 72 of the toilet 32 in a partial depression to move the valve top 36 to the open position 37 to allow a partial flush and alternatively a full depression to lift the trip lever 56 further to move the valve body 12 to the lifted position 70 and allow a full flush.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A dual flush flapper valve apparatus comprising:

a valve body, the valve body having a lower rim defining a bottom aperture, an upper rim defining a top aperture, and a sidewall extending from the lower rim to the upper rim, the lower rim being configured to selectively engage a tank valve seat of a toilet to seal and alternatively unseal the tank valve seat, the valve body having a body chain attachment coupled to the sidewall proximal the upper rim, the valve body being stepped with a diameter of the bottom aperture being greater than a diameter of the top aperture, the valve body comprising a lower step, a medial step, and an upper step, the medial step having a pair of angled transitions between each of the lower step and the upper step;

a valve top coupled to the valve body, the valve top being selectively engageable with the upper rim to seal and alternatively unseal the top aperture, the valve top having a valve chain attachment;

a top collar, the top collar being configured to be coupled to an overflow tube of the toilet;

a top hinge coupled to the valve top, the top hinge being pivotably coupled to the top collar;

a first chain coupled to the valve top, the first chain being coupled to the valve chain attachment and configured to attach to a trip lever of the toilet to move the valve top between a closed position sealing the top aperture and an alternate open position unsealing the top aperture;

a bottom hinge coupled to the valve body, the bottom hinge being coupled to the sidewall adjacent the lower rim;

a bottom collar coupled to the bottom hinge, the bottom hinge being pivotably coupled to the bottom collar; and a second chain coupled to the valve body, the second chain being coupled to the body chain attachment and configured to attach to the trip lever to move the valve body from a lowered position selectively engaging the tank valve seat to an alternate lifted position exposing the tank valve seat;

wherein the first chain and the second chain are arranged such that a partial depression of a handle of the toilet lifts the trip lever to move the valve top to the open position and a full depression of the handle lifts the trip lever further to move the valve body to the lifted position.

2. The dual flush flapper valve apparatus of claim 1 further comprising the top hinge being curved and flexible, the top hinge being arranged to pivot on the top collar when the first chain lifts the valve top to the open position and alternatively to flex and maintain the valve top in the closed position when the second chain lifts the valve body to the lifted position.

3. The dual flush flapper valve apparatus of claim 1 further comprising the bottom hinge having a squared shoulder portion pivotably coupled to the bottom collar and a tapered arm portion extending from the shoulder portion to the valve body.

4. The dual flush flapper valve apparatus of claim 1 further comprising the valve top having a cone portion, a disk portion coupled to the cone portion, and a hat portion coupled to the disk portion, the cone portion being selectively engageable within the top aperture and an underside of the disk portion being selectively engageable with the upper rim, the top hinge being coupled to the underside of the rim portion, the valve chain attachment being coupled to the hat portion.

5. The dual flush flapper valve apparatus of claim 4 further comprising the hat portion having an angled section and a rounded top section, the disk portion having a diameter greater than a diameter of each of the cone portion and the hat portion.

6. A dual flush flapper valve apparatus comprising:

a valve body, the valve body having a lower rim defining a bottom aperture, an upper rim defining a top aperture, and a sidewall extending from the lower rim to the upper rim, the valve body being stepped with a diameter of the bottom aperture being greater than a diameter of the top aperture, the valve body comprising a lower step, a medial step, and an upper step, the medial step having a pair of angled transitions between each of the lower step and the upper step, the lower rim being configured to selectively engage a tank valve seat of a toilet to seal and alternatively unseal the tank valve seat, the valve body having a body chain attachment coupled to the sidewall proximal the upper rim;

a valve top coupled to the valve body, the valve top having a cone portion, a disk portion coupled to the cone portion, and a hat portion coupled to the disk portion, the cone portion being selectively engageable within the top aperture and an underside of the disk portion being selectively engageable with the upper rim to seal and alternatively unseal the top aperture, the hat portion having an angled section and a rounded top section, the disk portion having a diameter greater than a diameter of each of the cone portion and the hat portion, the valve top having a valve chain attachment coupled to the rounded top section of the hat portion;

a top collar, the top collar being configured to be coupled to an overflow tube of the toilet;

a top hinge coupled to the valve top, the top hinge being coupled to the underside of the rim portion and pivotably coupled to the top collar, the top hinge being curved and flexible;

a first chain coupled to the valve top, the first chain being coupled to the valve chain attachment and configured to attach to a trip lever of the toilet to move the valve top between a closed position sealing the top aperture and an alternate open position unsealing the top aperture;

a bottom collar, the bottom collar being configured to be coupled to the overflow tube of the toilet beneath the top collar;

a bottom hinge coupled to the valve body, the bottom hinge having a squared shoulder portion pivotably coupled to the bottom collar and a tapered arm portion extending from the shoulder portion to the sidewall of the valve body adjacent the lower rim; and a second chain coupled to the valve body, the second chain being coupled to the body chain attachment and configured to attach to the trip lever to move the valve body from a lowered position selectively engaging the tank valve seat to an alternate lifted position exposing the tank valve seat, the top hinge being arranged to pivot on the top collar when the first chain lifts the valve top to the open position and alternatively to flex and maintain the valve top in the closed position when the second chain lifts the valve body to the lifted position;

wherein the first chain and the second chain are arranged such that a partial depression of a handle of the toilet lifts the trip lever to move the valve top to the open position and a full depression of the handle lifts the trip lever further to move the valve body to the lifted position.

* * * * *